United States Patent [19]

Gardner

[11] 4,406,695

[45] Sep. 27, 1983

[54] PROCESS FOR PRODUCING ALLOY STEEL PRODUCT OR IRON POWDER BY FURNACING GROUND IRON OR MOLTEN IRON ON A MOLTEN LEAD BATH

[76] Inventor: Herman E. Gardner, 23471 Sussex, Oak Park, Mich. 48237

[21] Appl. No.: 261,461

[22] Filed: May 7, 1981

[51] Int. Cl.[3] ..... C21B 15/00

[52] U.S. Cl. ..... 75/37; 75/45; 75/77; 75/53; 206/8; 75/0.5 R; 75/0.5 BA

[58] Field of Search ..... 75/290.5 BA, 33, 45, 75/53, 57, 36, 37, 77; 206/8 R

[56] References Cited

U.S. PATENT DOCUMENTS

| | | | |
|---|---|---|---|
| 2,089,782 | 8/1937 | Carlsson | 75/11 |
| 3,393,997 | 7/1968 | Faste | 75/59 |
| 3,558,304 | 1/1971 | McIntyre | 75/63 |
| 3,881,915 | 5/1975 | Proler | 75/11 |
| 3,929,465 | 12/1975 | Proler | 75/65 R |
| 4,345,990 | 8/1982 | Fahlstrom | 208/11 R |

*Primary Examiner*—L. Dewayne Rutledge
*Assistant Examiner*—Christopher W. Brody

[57] ABSTRACT

An iron containing 3% to 6% carbon and small quantities of manganese, silicon, sulfur and phosphorus produced by the blast furnace, electric furnace or other well-known furnaces, requires a relatively low temperature to convert to the molten state. This molten iron can be refined on the surface of molten lead at temperatures from 1000° C. to 1525° C. containing on the surface of the molten lead an oxide of lead or oxides of nickel, cobalt, iron, manganese, copper, zinc, and other metals whose oxides are reducible to the elemental state by carbon resulting in a refined or alloyed steel and/or increasing amount of molten lead. The carbon monoxide formed in this reaction may be combined with hydrogen at temperatures of 400° C. to 1000° C. and 100 atmospheres to 150 atmospheres in the presence of a proper catalyst according to the known Fischer-Tropsch reaction to form a petroleum product. Alternatively a finely ground iron containing 3% carbon to 6% carbon can be furnaced at 1000° C. to 1525° C. to produce either iron powder to fabricate powder metallurgy parts or a steel billet to make steels of any shape or form with rolling equipment. Also the carbides of nickel, cobalt and other elements can be converted to the elemental state by reaction with an oxide on the surface of the molten lead.

6 Claims, No Drawings

PROCESS FOR PRODUCING ALLOY STEEL PRODUCT OR IRON POWDER BY FURNACING GROUND IRON OR MOLTEN IRON ON A MOLTEN LEAD BATH

BACKGROUND OF THE INVENTION

Much of the initial work was done at the Jerusalem Institute of Technology in Israel.

This invention relates to the use of molten lead on whose surface a large number of chemical reactions occurs at temperatures from 1000° C. to 1525° C.

SUMMARY OF THE INVENTION

The object of the invention is to provide an alternate method for the manufacture of steel alloys of varying compositions, iron powder on a molten lead surface forming carbon monoxide which combines with hydrogen to form a petroleum product by the known Fischer-Tropsch process.

Another object of this invention is to reduce an oxide of lead on the surface of the molten lead with varying forms of carbon to produce increasing amounts of molten lead forming carbon monoxide.

Another object of this invention is to produce a petroleum product by oxidizing the surface of the molten lead with steam and/or carbon dioxide forming hydrogen and/or carbon monoxide, reducing the resulting lead oxide with elemental carbon or combined carbon to form carbon monoxide. The hydrogen and carbon monoxide are mixed together in the presence of a catalyst at temperatures from 400° C. to 1000° C. and 100 atmospheres to 150 atmospheres to form a petroleum product by the Fischer-Tropsch process.

DESCRIPTION OF THE PREFERRED EMBODIMENTS

An advantage of this invention in the processing of steel is the substantial lower temperature required to melt a 4% to 6% steel. Also all by-products of these reactions are used.

Since molten lead is the central part of this invention, these properties of lead allow it to be used:

Vapor Pressure at Different Temperatures

| Temp °C. | Pressure (mm of Hg) |
|---|---|
| 808 | 0.08 |
| 1000 | 1.77 |
| 1200 | 23.29 |
| 1365 | 166 |
| 1525 | 760 |
| 1870 | 6.3 atmospheres (6 × 760) |
| 2100 | 11.7 atmospheres (11 × 760) |
| Density | 11.34 g/cm$^3$ at 20° C. |
| | 10.686 g/cm$^3$ at 327.4° C. (Liquid) |
| Melting Point 327.4° C. | |
| Boiling Point 1525° C. | |
| Specific Heat 0.0306 ca./g °C. at 20° C. | |
| Latent Heat of Fusion 6.26 cal/g | |
| Latent Heat of Vaporization 202.0 cal/g | |

These facts are taken from the text: Hansen, Max, "Constitution of Binary Alloys", second edition, McGraw, 1958.

Iron and lead are completely insoluble both in the liquid state and solid state.

There is slight solubility of nickel in lead and slight solubility of lead in nickel.

Cobalt and lead are virtually insoluble in each other.

Although two melts occur with copper and lead, there appears to be appreciable solubility of either into the other at the higher temperatures. There appears to be appreciable solubility of manganese in lead and lead in manganese at elevated temperatures.

The compound $Co_2C$ forms at a composition of 9.25% C. Also the compound $Co_3C$ forms at 6.30% carbon. Nickel carbide ($Ni_3C$) forms at a composition of 6.39%.

Iron Carbide ($Fe_3C$) forms at a composition of 6.67% C.

Above 850° C. lead and lead oxide form 2 melts insoluble in each other. Since the density of the lead oxide is less than that of lead, the lead oxide floats on the lead surface.

Many oxides are readily reduced with carbon at high temperatures.

Basically steel is produced by reducing iron ore with coke in a blast furnace and refining this molten product by the basic oxygen process of the basic open hearth process. Continuous casting and rolling results in a final steel product. In these refining processes the carbon ends ultimately as carbon dioxide ($CO_2$) vented into the air.

In this invention the molten iron from the blast furnace is produced with carbon as the only impurity and the other impurity elements manganese, silicon, sulfur, and phosphorus in low percentages or electric melting of scrap steel with coke broken electrodes, graphite or any other carbon source resulting in a 4% to 6% carbon iron is the raw material. When the molten iron is poured on the molten lead containing oxygen, a chemical reaction occurs according to this equation:

$$Fe(C)+Pb(O)—CO+Fe+Pb$$

The oxygen is obtained in a number of ways: Iron oxide (FeO) is added to the surface of the lead. Lead is oxidized with pure oxygen, oxygen in air, steam ($H_2O$) or carbon dioxide ($CO_2$).

Other oxides like nickel oxide, cobalt oxide, manganese oxide, etc. are applied to the surface of the lead resulting in alloying of the steel with these elements.

Alternately these oxides may be mixed with a ground iron (Fe containing 4% C to 6% C) applied to the molten lead surface forming ultimately an iron powder.

In all of the possible reactions at the higher temperatures carbon monoxide is formed which combined with hydrogen reacts to an oil product by the Fischer-Tropsch reaction. The hydrogen is obtained from an outside source or from the reaction of steam on lead.

$$H_2O+Pb—PbO+H_2$$

The Fischer-Tropsch reaction combines hydrogen and carbon monoxide in a proper ratio at temperatures of 400° C. to 500° C., at pressures of 100 atmospheres to 150 atmospheres in the presence of a catalyst to form a petroleum like product:

$$13H_2+6CO—C_6H_{14}+6H_20$$

If 100 grams molten iron containing 4% carbon reacts completely with excess oxygen on the molten lead surface, 96 grams of pure iron and 10 grams of carbon monoxide yields ideally 5 grams of $C_6H_{14}$. Thus a million metric tons of steel extrapolates to 52,000 metric tons of $C_6H_{14}$.

The advantage of this process is that no heat is required to produce the petroleum like product by the Fischer-Tropsch process.

What is claimed is:

1. A process for producing a carbon containing iron powder by furnacing a mixture comprising of at least 77 percent of a ground iron powder containing 3 to 6 percent carbon and the balance being an oxygen bearing iron powder material on a molten lead bath at 1100° C. to 1200° C. wherein carbon monoxide is produced as a by product of the furnacing step and is converted to a petroleum product using hydrogen in the Fischer-Tropsch process.

2. The process according to claim 1 wherein the molten lead bath contains lead oxide on its surface.

3. A process for producing an alloy steel powder by furnacing a ground iron powder containing 3 to 6 percent of carbon on a molten lead bath which has a molten metallic oxide selected from the group consisting of NiO, CoO, MnO, and CuO on its surface at 1100° C. to 1200° C. wherein carbon monoxide is produced as a by product of the furnacing step and is converted to a petroleum product using hydrogen in the Fischer Tropsch reaction.

4. A process for producing an alloy steel powder by furnacing a mixture containing at least 77 percent ground iron powder containing 3 to 6% carbon and the balance being metallic oxides selected from the group consisting of NiO, MnO, CuO, CoO on a molten bath of lead at 1100° C. to 1200° C. wherein carbon monoxide is produced as a by product of the furnacing step and is converted to a petroleum product using hydrogen in the Fischer Tropsch process.

5. A process for producing an alloy steel product by furnacing at 1200° C. to 1500° C. a mixture comprising a ground iron containing 3 to 6 percent carbon and a metal oxide selected from the group consisting of FeO, NiO, CoO, MnO, and CuO on a molten lead bath wherein said mixture forms a steel cake-like structure to be further processed by rolling operations and carbon monoxide is produced as a by product of the furnacing step and is converted to a petroleum product using hydrogens in the Fischer-Tropsch reaction.

6. A process for producing an alloy steel product by furnacing a molten iron containing 3 to 6 percent carbon on a molten lead bath said molten lead bath having a metal oxide selected from the group consisting of FeO, NiO, CoO, MnO, and CuO on the bath surface wherein said molten iron and metal oxides form a steel cake-like structure to be further processed by rolling operations and carbon monoxide is produced as a by product of the furnacing step and is converted to a petroleum product using hydrogen in the Fischer-Tropsch reaction.

* * * * *